US010843886B2

(12) United States Patent
Lee et al.

(10) Patent No.: US 10,843,886 B2
(45) Date of Patent: Nov. 24, 2020

(54) FRICTION SHAFT FOR SLITTER

(71) Applicant: YUL RIM AIR SHAFT CO., LTD., Incheon (KR)

(72) Inventors: Jae sik Lee, Gyeonggi-do (KR); Soo hyung Lee, Gyeonggi-do (KR)

(73) Assignee: YUL RIM AIR SHAFT CO., LTD., Incheon (KR)

( * ) Notice: Subject to any disclaimer, the term of this patent is extended or adjusted under 35 U.S.C. 154(b) by 35 days.

(21) Appl. No.: 16/355,334

(22) Filed: Mar. 15, 2019

(65) Prior Publication Data

US 2019/0291996 A1 Sep. 26, 2019

(30) Foreign Application Priority Data

Mar. 20, 2018 (KR) ..... 10-2018-0032058

(51) Int. Cl.

| | |
|---|---|
| ***B65H 18/16*** | (2006.01) |
| ***B65H 75/24*** | (2006.01) |
| ***B65H 35/06*** | (2006.01) |
| ***B65H 18/04*** | (2006.01) |
| ***B65H 23/16*** | (2006.01) |

(52) U.S. Cl.

CPC ..... *B65H 18/16* (2013.01); *B65H 18/04* (2013.01); *B65H 23/16* (2013.01); *B65H 35/06* (2013.01); *B65H 75/248* (2013.01); *B65H 2301/413* (2013.01); *B65H 2555/11* (2013.01)

(58) Field of Classification Search

CPC ..... B65H 18/16; B65H 18/04; B65H 23/16; B65H 35/06; B65H 75/248; B65H 2301/413; B65H 2555/11

See application file for complete search history.

(56) References Cited

U.S. PATENT DOCUMENTS

| | | | | |
|---|---|---|---|---|
| 6,405,970 | B1 * | 6/2002 | Ueyama | B65H 75/242 242/530.3 |
| 2016/0251197 | A1 * | 9/2016 | Avagliano | B65H 18/04 242/571.2 |
| 2017/0102014 | A1 * | 4/2017 | Re | B65H 16/04 |

FOREIGN PATENT DOCUMENTS

KR 10-2014-0083406 7/2014

* cited by examiner

*Primary Examiner* — Michael E Gallion
(74) *Attorney, Agent, or Firm* — IP & T Group LLP

(57) ABSTRACT

A friction shaft for a slitter has winding tubes disposed on an outer surface thereof to roll unit materials formed by cutting a raw material such as various kinds of paper, fabric, or film with predetermined intervals includes a first rotary shaft, tubes, brake pads, a second rotary shaft, pressing members, first rotary tubes, second rotary tubes, first and second bearings, first elastic members, guide members, second elastic members, and lugs for clamping.

14 Claims, 15 Drawing Sheets

FRICTION SHAFT FOR SLITTER

CROSS REFERENCE TO RELATED APPLICATION

The present application claims priority to Korean Patent Application No. 10-2018-0032058, filed Mar. 20, 2018, the entire contents of which is incorporated herein for all purposes by this reference.

BACKGROUND OF THE INVENTION

Field of the Invention

The present invention relates to a friction shaft for a slitter and, more particularly, to a friction shaft for a slitter, the friction shaft controlling winding tension of a winding tube using compressed air to enable correspondence to the thickness and weight of a unit material formed by a slitter so that the unit material can be stably wound on the winding tube.

Description of the Related Art

In general, a slitter is an apparatus that cuts raw materials such as various kinds of paper, fabric, or film with predetermined intervals. Paper tubes are used to roll several unit materials formed by a slitter.

Accordingly, a friction shaft for a slitter which rotates paper tubes using compressed air was used to roll several unit materials such as various kinds of paper, fabric, or film on paper tubes.

In relation to this matter, there has been provided in Patent Document 1 a friction shaft for a slitter which includes: a rod-shaped winding shaft that is rotated by a winding motor; a first hole that is bored in the winding shaft in the longitudinal direction of the winding shaft; a plurality of third holes that is bored from the outer circumferential surface of the winding shaft to the first hole and arranged with predetermined intervals in the extension direction of the first hole; a plurality of holders that are fitted in a paper tube for winding a unit material, are short tubes sequentially fitted on the outer circumference of the winding shaft, and are disposed at the positions of the third holes; and a first pneumatic pressure generator that supplies compressed air to the first hole to press the paper tube with the holders, in which the holders are short tubes and have a plurality of lug seats, and include: a holder base having a connection hole bored to connect the third holes and the lug seats; lugs fitted in the lug seats to be movable in the radial direction of the winding shaft; a spring having an end supported by the lugs and the other end supported by the lug seats to provide force that elastically pushes the lugs in the radial direction of the winding shaft; a fixing cover fixed to the holder base and pressing the outer edges of the lugs to keep the lugs in the lug seats; and a pneumatic guide guiding the compressed air supplied to the first hole to the center of the winding shaft.

However, according to Patent Document 1, the size or strength of the spring is limited due to the structure, so if a unit material is thick and heavy exceeding the elasticity of the spring, the unit material is difficult to be wound well on the winding tube.

That is, according to Patent Document 1, it was difficult to adjust elasticity of the spring over winding tension of the lugs using compressed air.

Documents of Related Art (Patent Document 1) Korean Patent Application Publication No. 10-2014-0083406 (published on Jul. 4, 2014)

SUMMARY OF THE INVENTION

Accordingly, an object of the present invention is to provide a friction shaft for a slitter, the friction shaft controlling winding tension of a winding tube using compressed air to enable correspondence to the thickness and weight of a unit material formed by a slitter so that the unit material can be stably wound on the winding tube.

In order to achieve the objects of the present invention, there is provided a friction shaft for a slitter that has winding tubes disposed on an outer surface thereof to roll unit materials formed by cutting a raw material such as various kinds of paper, fabric, or film with predetermined intervals.

The friction shaft comprising a first rotary shaft rotated by a driving motor and supplied with compressed air from an air supplier.

In the first rotary shaft, a moving passage elongated in a longitudinal direction of the first rotary shaft is formed in the first rotary shaft, first and second supply holes for receiving the compressed air are formed at a side of an outer surface to be connected with the moving passage, moving holes connected with the moving passage are formed with predetermined intervals at an opposite side of the outer surface in the longitudinal direction of the first rotary shaft and are arranged around the first rotary shaft with predetermined intervals, first discharge holes are formed at the opposite side of the outer surface to be longer than the moving holes in the longitudinal direction of the first rotary shaft and are arranged with predetermined intervals around the first rotary shaft between the moving holes, locking steps protrude from open ends of the first discharge holes, and connection holes connecting the moving passage and the first discharge holes are formed therein, The friction shaft includes tubes disposed in the first discharge holes and having third supply holes connected with the connection holes.

The friction shaft includes brake pads for torque that are disposed in the first discharge holes to be adjacent to each other, have a first friction portion protruding from an outer surface thereof, and have a locking portion protruding from the outer surface around the first friction portion to be locked to the locking step.

The friction shaft includes a second rotary shaft disposed to be movable through the moving passage.

In the second rotary shaft, moving grooves for sending compressed air supplied from the second supply holes to the connection holes are formed in a circular shape and elongated on a side of an outer surface in a longitudinal direction of the second rotary shaft, and first fastening holes facing the moving holes are formed with predetermined intervals on an opposite side of the outer surface in the longitudinal direction of the second rotary shaft and are arranged with predetermined intervals around the second rotary shaft.

The friction shaft includes pressing members fastened in the first fastening holes and exposed from the moving holes.

The friction shaft includes first rotary tubes disposed on the outer surface of the first rotary shaft to be adjacent to each other in the longitudinal direction of the first rotary shaft with the winding tubes on outer surfaces thereof.

In each of the first rotary tubes, a second friction portion that generates friction with the first friction portion protrudes from an inner surface, first and second fitting spaces are formed at both sides of the second friction portion, fitting holes are formed on a side, which faces the second fitting space, of the second friction portion with predetermined intervals around the first rotary tube, and second discharge holes connected with the second fitting space are formed on an outer surface with predetermined intervals around the first rotary tube.

The friction shaft includes second rotary tubes disposed on the outer surface of the first rotary shaft and movably fitted in the second fitting spaces.

In each of the second rotary tubes, locking holes facing the second discharge holes are formed on an outer surface with predetermined intervals around the second rotary tube, first inclined surfaces are formed in the locking holes, fitting holes facing the fitting holes are formed on the outer surface with predetermined intervals around the second rotary tube, locking steps protrude at a side of an inner surface close to the fitting holes, and a third fitting space is formed at an opposite side of the inner surface.

The friction shaft includes first and second bearings that are fitted in the first and third fitting spaces, respectively to be locked to the second friction portions and locking steps and are disposed on the outer surface of the first rotary shaft.

The friction shaft includes first elastic members fitted in the fitting holes.

The friction shaft includes guide members that are disposed in the second discharge holes, have a second inclined surface formed at a side of an outer surface to be guided by the first inclined surface, have a locking hole formed at an opposite side of the outer surface, and have a second fastening hole formed on the outer surface around the locking hole.

The friction shaft includes second elastic members fitted in the locking holes of the pressing members.

The friction shaft includes lugs for clamping that are disposed in the second discharge holes and have a third fastening hole connected to the second fastening hole by a fastener.

When the compressed air is supplied to the moving passage through the first supply hole, the second rotary shaft is moved through the moving passage by pressure of the compressed air and the pressing members are moved through the moving holes, the second bearings and the second rotary tubes are sequentially pressed by the moving pressing members, and the second inclined surfaces are guided by the first inclined surfaces, so the lugs for clamping are discharged from the second discharge holes and the discharged lugs for clamping come in close contact with inner surfaces of the winding tubes.

When the compressed air is supplied to the third supply holes sequentially through the second supply hole, the moving grooves, and the connection holes, the tubes are expanded and the first friction portions of the brake pads for torque are discharged from the first discharge hole and come in close contact with the second friction portions of the first rotary tubes.

The present invention, unlike the related art, has the effect of winding unit materials with winding tension of winding tubes that is decreased or increased, depending on pressure of compressed air that is supplied.

That is, unlike the related art, it is possible to wind unit materials in accordance with the thickness and weight of the unit materials.

Further, unlike the related art, it is possible to provide appropriate pressure to lugs for clamping on winding tubes such as paper tubes that are easily damaged.

Further, unlike the related art, it is possible to prevent slip of winding tubes due to insufficient friction of lugs for clamping.

Further, when winding tension of winding tubes that wind unit materials becomes larger than torque of first and second rotary shafts, the winding tubes can slip in the rotational direction of the first and second rotary shaft.

That is, a winding tube can have the same winding tension as other winding tubes around it by slipping, so it is possible to prevent deterioration of product quality in that some unit materials are loosely wound and some unit materials are tightly wound due to different winding tension of the winding tube.

In other words, product quality is improved by normally rolling a plurality of unit material around a plurality of winding tubes with constant winding tension.

Further, according to the present invention, since the pressure on the winding tubes by the lugs for clamping is removed and the lugs for claming are inserted back into the first rotary tubes when compressed air is not supplied, the winding tubes can be more easily mounted and separated, as compared with the related art.

Further, according to the present invention, since the third rotary tubes are installed on and separated from the first rotary tubes by fastening and unfastening the fourth and fifth fastening holes, it is possible to adjust the friction area for rotation with the brake pads for torque.

That is, it is possible to control the rotational speeds of the winding tubes.

Further, according to the present invention, since the locking portions of the third rotary tubes are locked and fixed in the locking grooves of the first rotary tubes, the third rotary tubes can be quickly installed on the first rotary tubes.

Further, according to the present invention, the winding operation of the winding tubes can be quickly performed and quickly stopped by the elasticity of the first, second, and third elastic members.

Further, according to the present invention, since the first, second, and third elastic members are springs with high elasticity, the winding operation of the winding tubes can be more quickly performed and quickly stopped.

Further, according to the present invention, when the locking portion of the second rotary shaft is blocked by an end of the moving shaft, the lugs for clamping are not excessive exposed from the second discharge holes of the first rotary tubes.

That is, it is possible to prevent the lugs for clamping from damaging the inner surfaces of the winding tubes by excessively pressing the inner surfaces.

Further, according to the present invention, since the tubes are quickly expanded by nozzles that guide compressed air, it is possible to quickly prepare for winding.

Further, according to the present invention, since both open sides of the tubes are sealed by sealing members to prevent leakage of compressed air, friction between the first friction portions of the brake pads for torque and the second and third friction portions of the first and third rotary tubes can be maintained at a predetermined level.

Further, according to the present invention, since protective films prevent damage to the tubes even if the sealing members strongly press the tubes, it is possible to prevent leakage of compressed air through damaged tubes.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinafter, configurations of exemplary embodiments of the present invention will be described with reference to the accompanying drawings.

Figure 1:
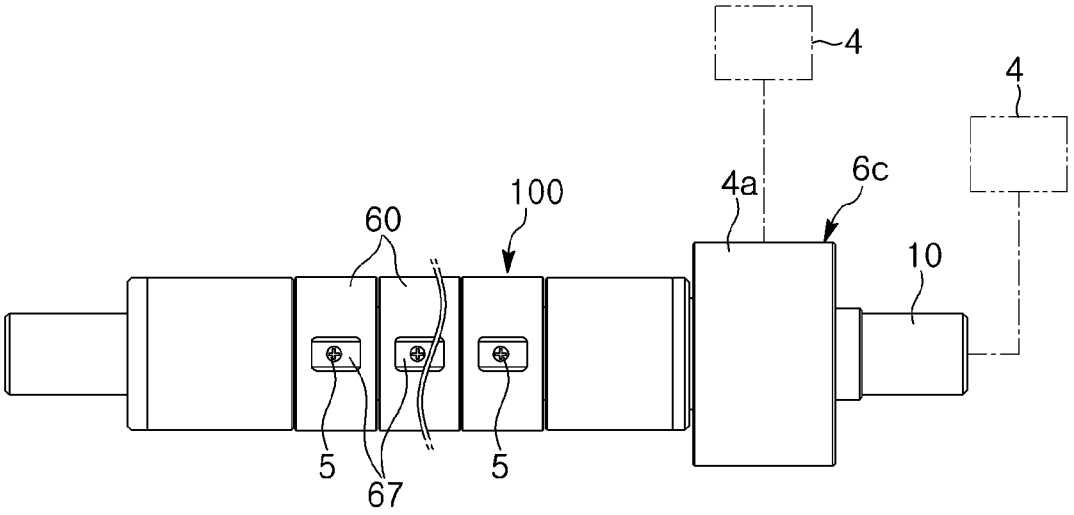
FIGS. 1 and 2 are views showing an installation state of a friction shaft for a slitter according to an embodiment of the present invention.
Figure 2:
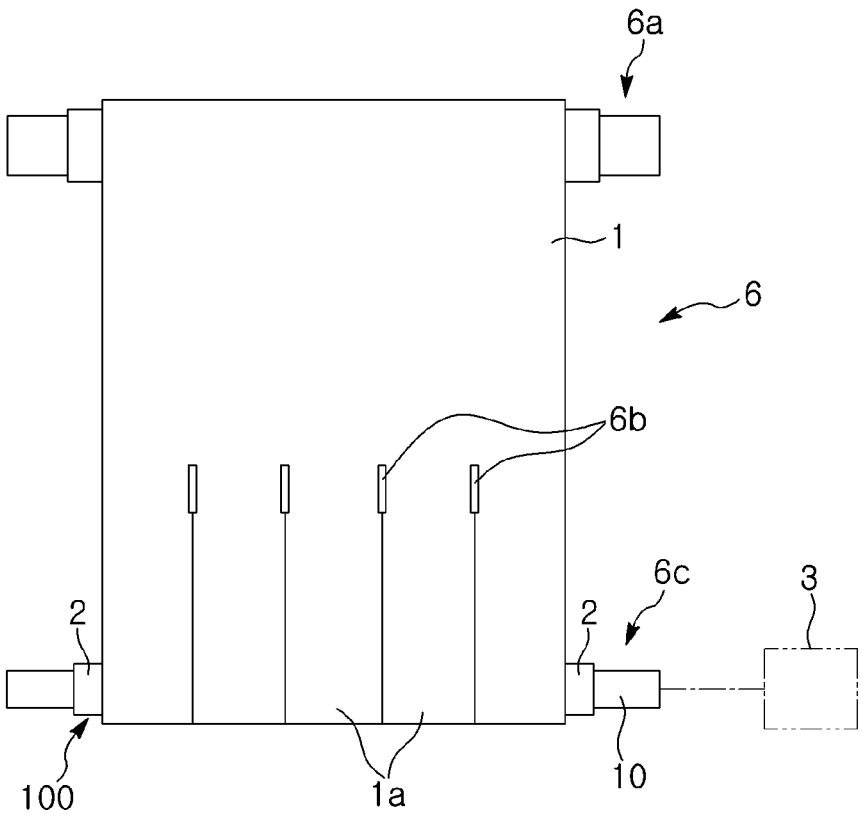
Figure 3:
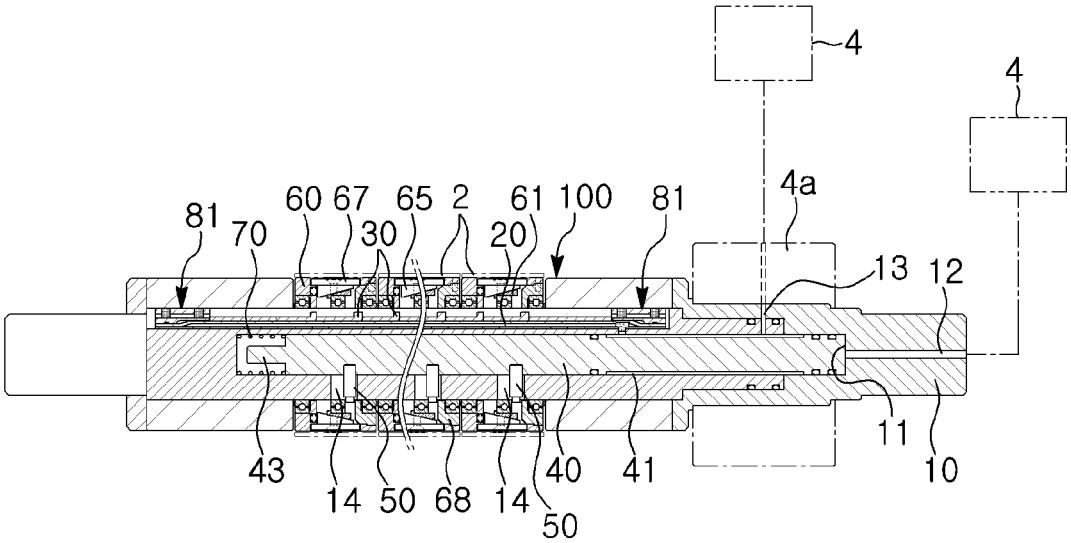
FIG. 3 is a cross-sectional view of the friction shaft for a slitter according to an embodiment of the present invention.
Figure 4A:
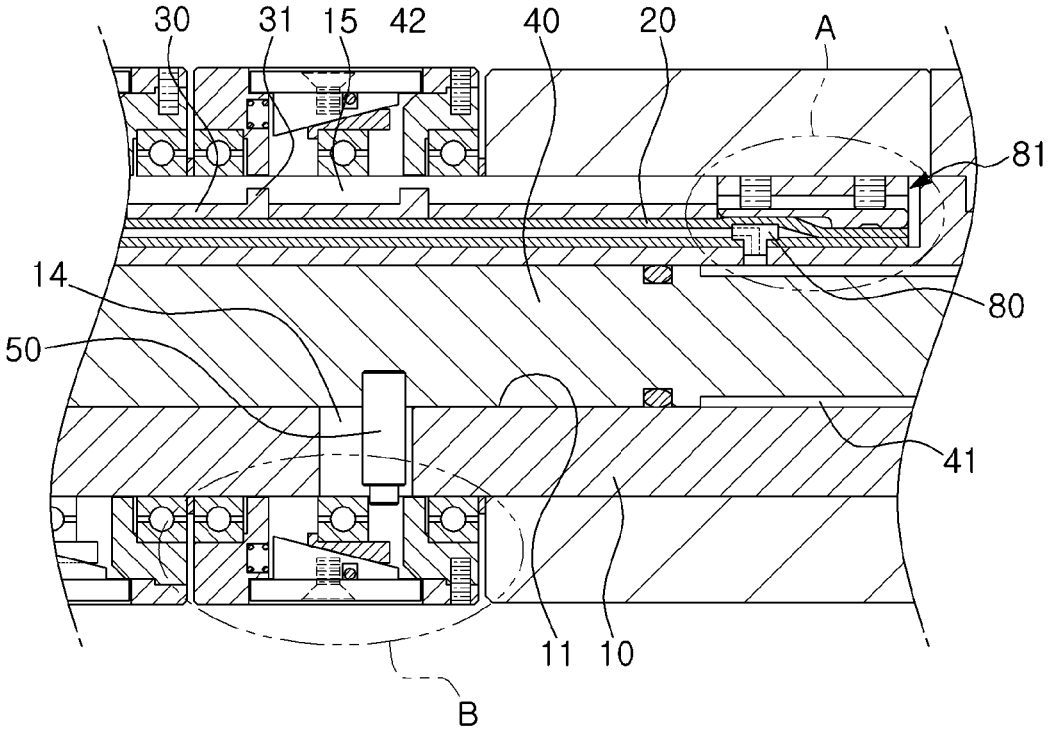
FIGS. 4A to 10C are partial enlarged cross-sectional views and detailed views of FIG. 3.
Figure 4B:
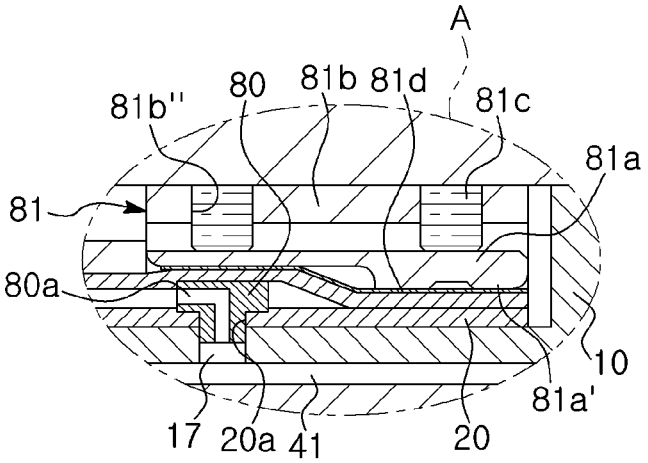
Figure 4C:
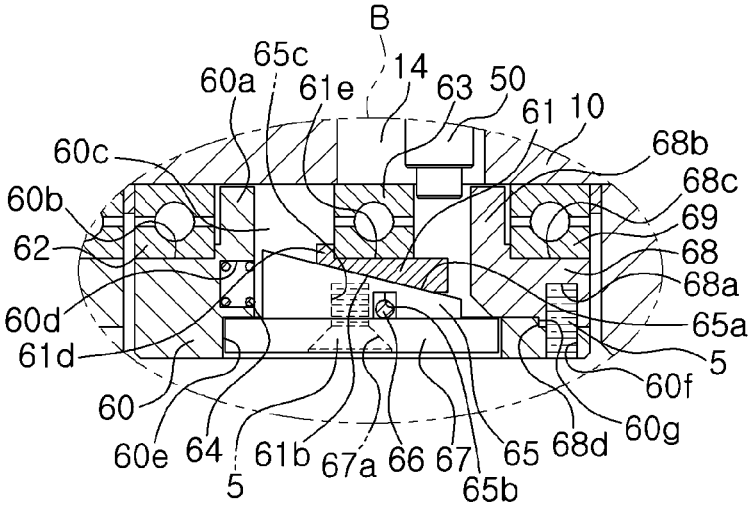
Figure 5:
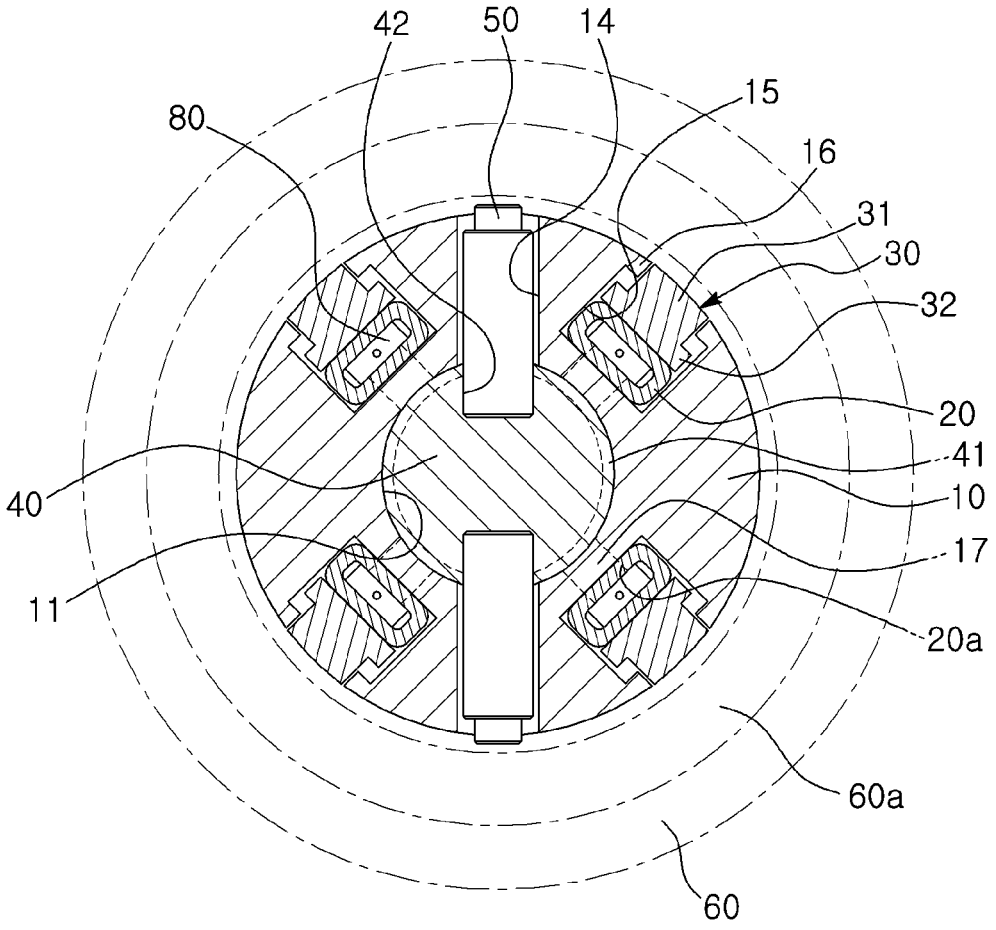
Figure 6A:
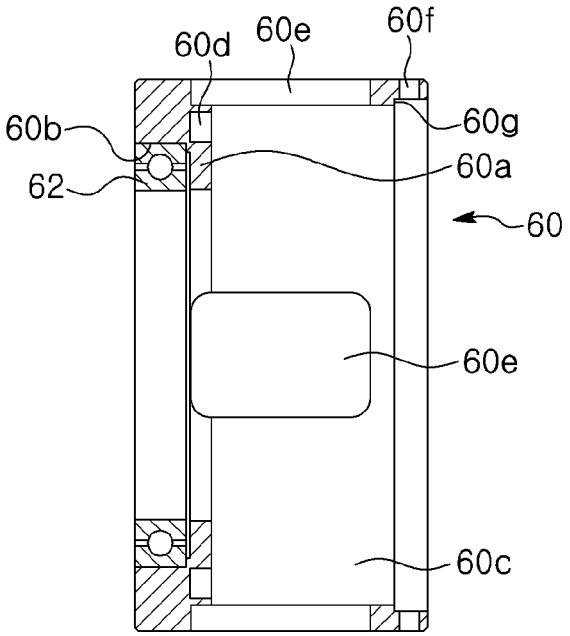
Figure 6B:
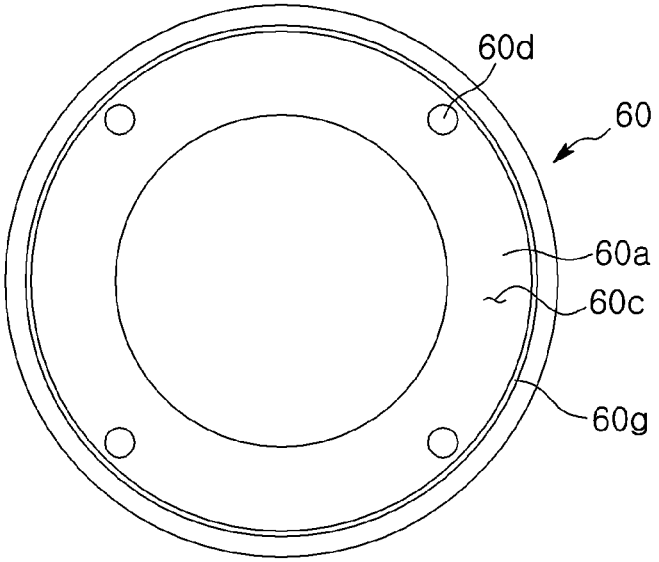
Figure 7A:
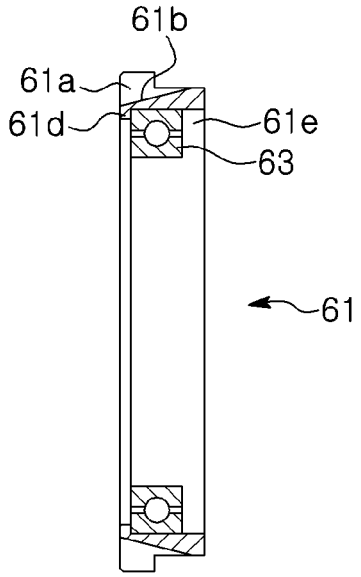
Figure 7B:
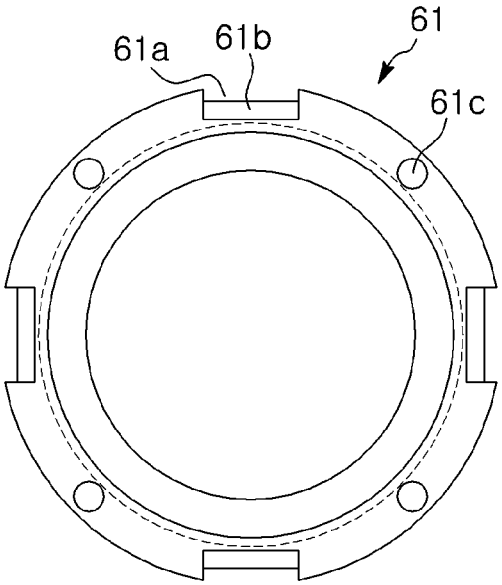
Figure 8A:
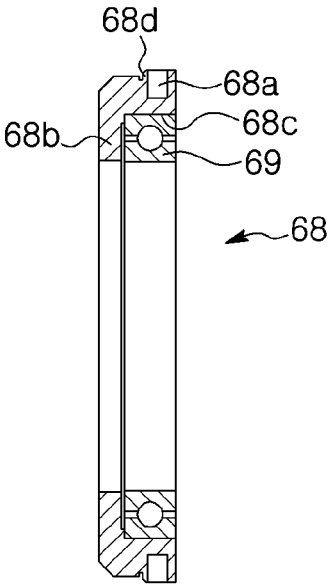
Figure 8B:
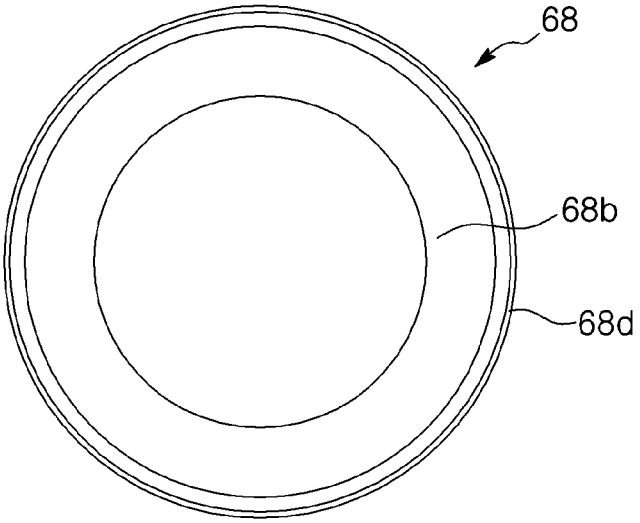
Figure 9A:
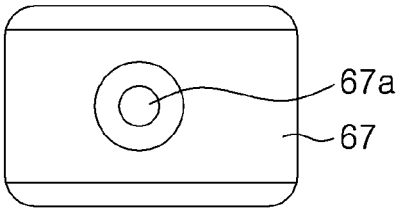
Figure 9B:
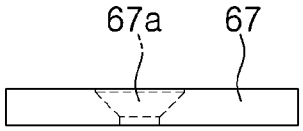
Figure 9C:
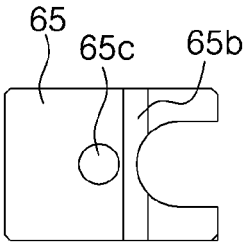
Figure 9D:
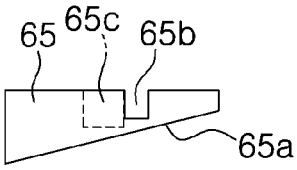
Figure 9E:
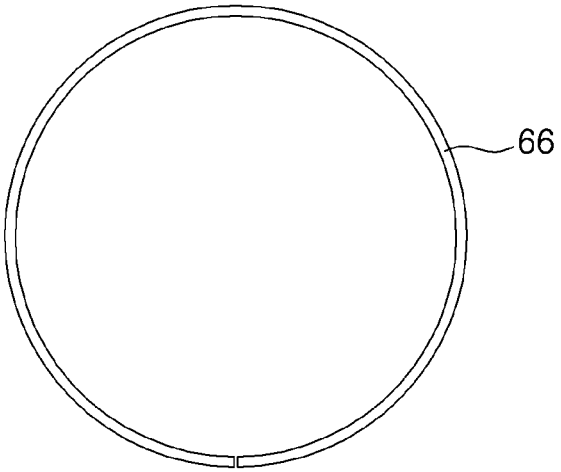
Figure 10A:
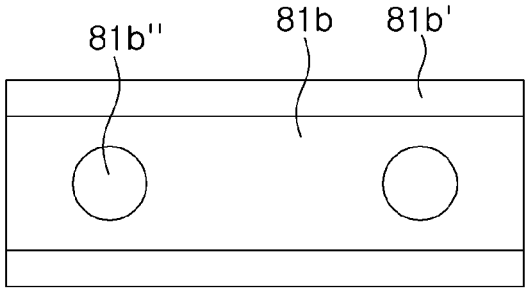
Figure 10B:
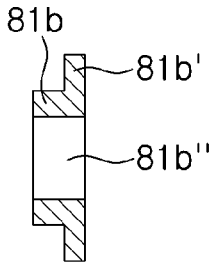
Figure 10C:
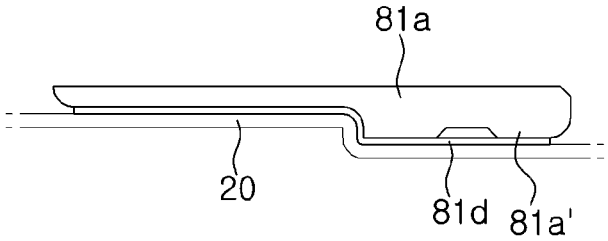
Figure 11A:
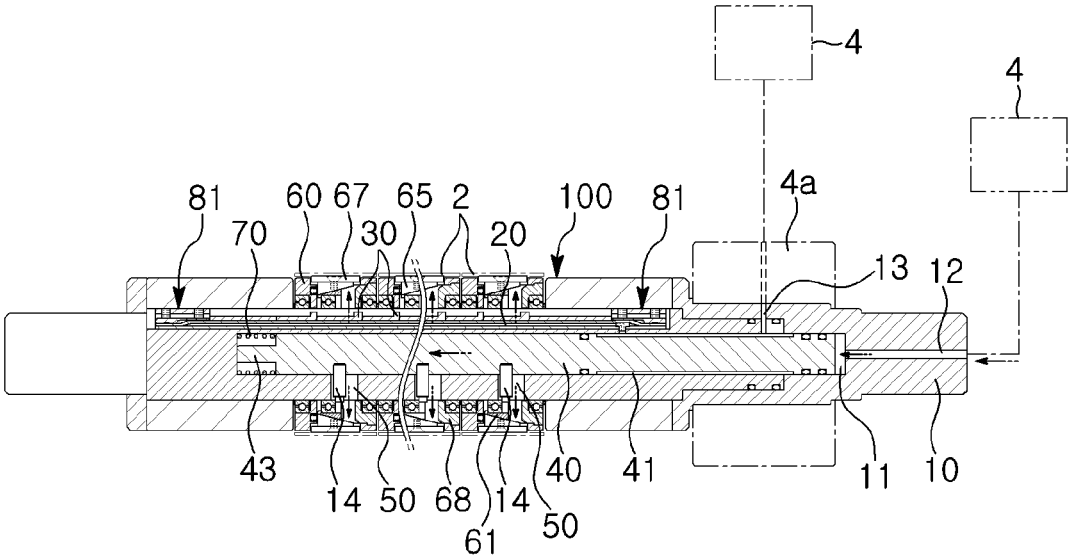
FIGS. 11A to 12B are views showing a use state of the friction shaft for a slitter according to an embodiment of the present invention.
Figure 11B:
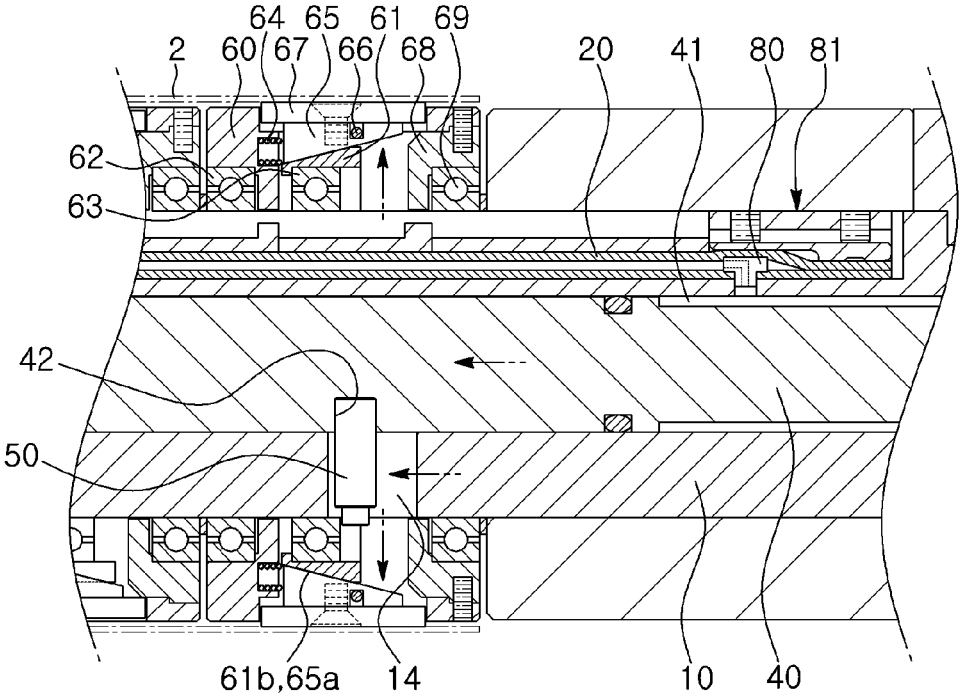
Figure 12A:
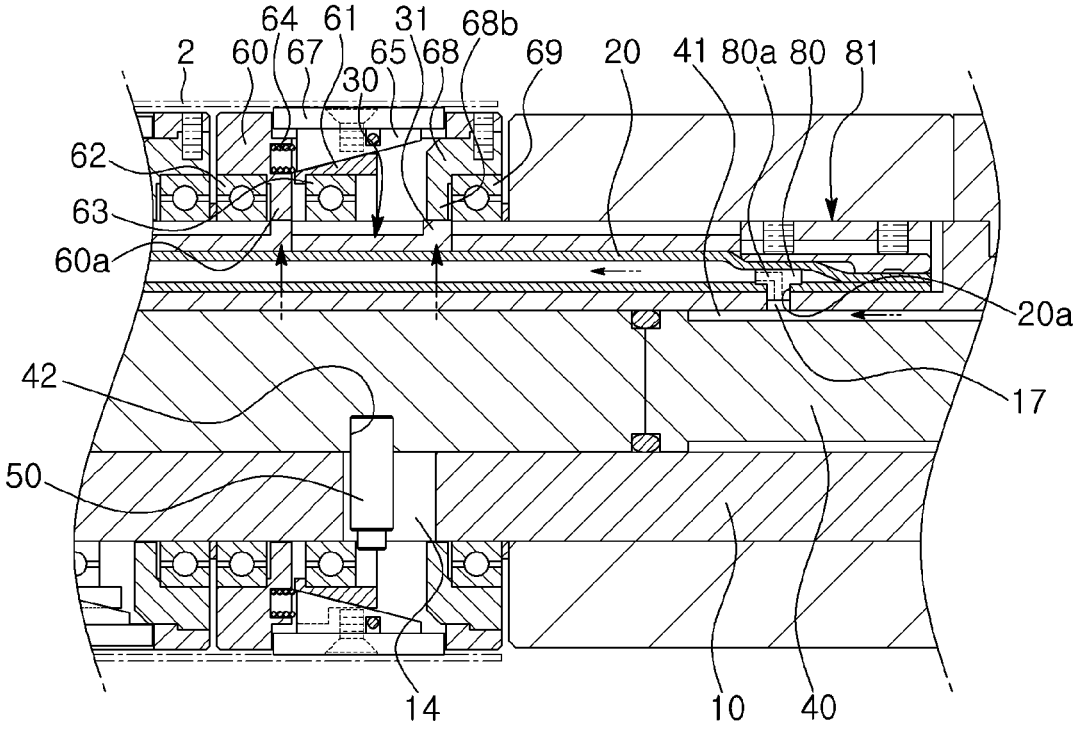
Figure 12B:
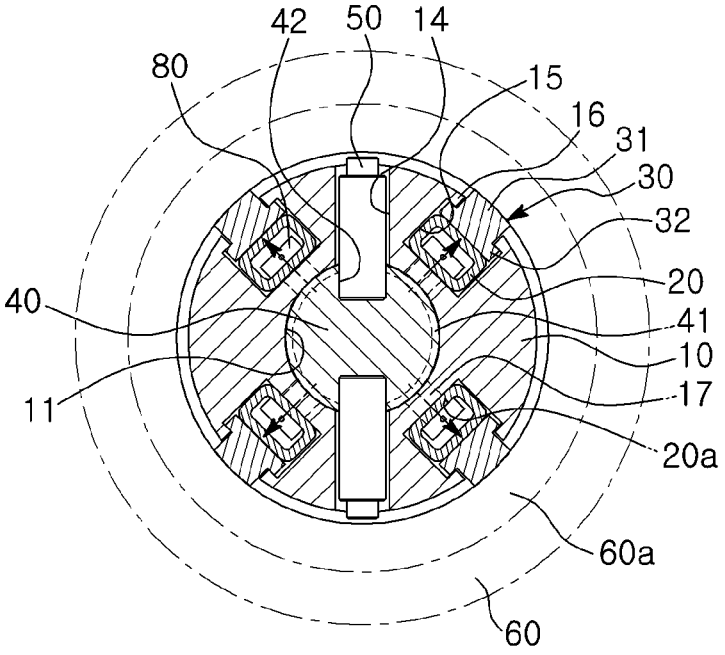

As shown in FIGS. 1 to 12B, a friction shaft 100 for a slitter according to an embodiment of the present invention is installed on a slitter 6 that includes: a feeder 6*a* that supplies a rolled raw material 1 such as various kinds of paper, fabric, or film; cutters 6*b* that cut the raw material 1 with predetermined intervals; and a winder 6*c* that rolls unit materials 1*a* cut with predetermined intervals from the raw material 1 on winding tubes 2.

That is, the friction shaft 100 for a slitter is installed on the winder 6*c* of the slitter 6.

The winder 6*c* includes a driving motor 3 that rotates the friction shaft 100 for a slitter, an air supplier 4 that supplies compressed air to the friction shaft 100 for a slitter such as an air compressor, and an air transmitter 4*a* that separately supplies compressed air of another air supplier 4 to the friction shaft 100 for a slitter.

In this embodiment, several unit materials 1*a* are formed and several winding tubes 2 corresponding to the unit materials are also disposed on the outer surface of the friction shaft 100 for a slitter.

The winding tubes 2 are paper tubes or FRP cores.

The friction shaft 100 for a slitter includes a first rotary shaft 10 that is rotated by the driving motor 3 and is supplied with compressed air from the air supplier 4.

In the first rotary shaft 10, a moving passage 11 elongated in the longitudinal direction of the first rotary shaft 10 is formed in the first rotary shaft 10, first and second supply holes 12 and 13 for receiving the compressed air are formed at a side of the outer surface to be connected with the moving passage 11, moving holes 14 connected with the moving passage 11 are formed with predetermined intervals at an opposite side of the outer surface in the longitudinal direction of the first rotary shaft 10 and are arranged around the first rotary shaft 10 with predetermined intervals, first discharge holes 15 are formed at the opposite side of the outer surface to be longer than the moving holes 14 in the longitudinal direction of the first rotary shaft 10 and are arranged with predetermined intervals around the first rotary shaft 10 between the moving holes 14, locking steps 16 protrude from open ends of the first discharge holes 15, and connection holes 17 connecting the moving passage 11 and the first discharge holes 15 are formed therein.

The first rotary shaft 10 is formed by combining a plurality of tube-shaped shafts.

The friction shaft 100 for a slitter includes tubes 20 disposed in the first discharge holes 15 and having a third supply hole 20*a* connected with the connection hole 17.

The friction shaft 100 for a slitter includes brake pads 30 for torque that are disposed in the first discharge holes 15 to be adjacent to each other, have a first friction portion 31 protruding from the outer surface thereof, and have a locking portion 32 protruding from the outer surface around the first friction portion 31 to be locked to the locking step 16.

The brake pads 30 for torque are formed in a shape similar to a plate and are made of a material having high wear resistance.

The friction shaft 100 for a slitter includes a second rotary shaft 40 disposed to be movable through the moving passage 11.

In the second rotary shaft 40, moving grooves 31 for sending compressed air supplied from the second supply holes 13 to the connection holes 17 are formed in a circular shape and elongated on a side of the outer surface in the longitudinal direction of the second rotary shaft 40, and first fastening holes 42 facing the moving holes 14 are formed with predetermined intervals on an opposite side of the outer surface in the longitudinal direction of the second rotary shaft 40 and are arranged with predetermined intervals around the second rotary shaft 40.

The friction shaft 100 for a slitter includes pressing members 50 disposed in the first fastening holes 42 and exposed from the moving holes 14.

The friction shaft 100 for a slitter includes first rotary tubes 60 disposed on the outer surface of the first rotary shaft 10 to be adjacent to each other in the longitudinal direction of the first rotary shaft 10 with the winding tubes 2 on the outer surfaces thereof.

In each of the first rotary tubes 60, a second friction portion 60*a* that generates friction with the first friction portion 31 protrudes from the inner surface, first and second fitting spaces 60*b* and 60*c* are formed at both sides of the second friction portion 60*a*, fitting holes 60*d* are formed on a side, which faces the second fitting space 60*c*, of the second friction portion 60*a* with predetermined intervals around the first rotary tube 60, and second discharge holes 60*e* connected with the second fitting space 60*c* are formed on the outer surface with predetermined intervals around the first rotary tube 60.

The friction shaft 100 for a slitter includes second rotary tubes 61 disposed on the outer surface of the first rotary shaft 10 and movably fitted in the second fitting spaces 60*c*.

In each of the second rotary tubes 61, locking holes 61*a* facing the second discharge holes 60*e* are formed on the outer surface with predetermined intervals around the second rotary tube 61, first inclined surfaces 61*b* are formed in the locking holes 61*a*, fitting holes 61*c* facing the fitting holes 60*d* are formed on the outer surface with predetermined intervals around the second rotary tube 61, locking steps 61*d* protrude at a side of the inner surface close to the fitting holes 61*c*, and a third fitting space 61*e* is formed at the opposite side of the inner surface.

The friction shaft 100 for a slitter includes first and second bearings 62 and 63 that are fitted in the first and third fitting spaces 61*b* and 61*e*, respectively to be locked to the second friction portions 60*a* and locking steps 61*d* and are disposed on the outer surface of the first rotary shaft 10.

The first and second bearings 62 and 63 may be ball bearings.

The friction shaft 100 for a slitter includes first elastic members 64 fitted in the fitting holes 60*d* and 61*c*.

The friction shaft 100 for a slitter includes guide members 65 that are disposed in the second discharge holes 60*e*, have a second inclined surface 65*a* formed at a side of the outer surface to be guided by the first inclined surface 61*b*, have a locking hole 65*b* formed at the opposite side of the outer surface, and have a second fastening hole 65*c* formed on the outer surface around the locking hole 65*b*.

The guide members 65 are formed similar to a trapezoidal shape.

The friction shaft 100 for a slitter includes second elastic members 66 fitted in the locking holes 65*b* of the guide members 65.

The friction shaft 100 for a slitter includes lugs 67 for clamping that are disposed in the second discharge holes 60*e* and have a third fastening hole 67*a* connected to the second fastening hole 65*c* by a fastener 5.

The lugs 67 for clamping are made of a material having high wear resistance.

Fourth fastening holes 60*f* connected with the second fitting spaces 60*c* are formed on the outer surface around the second discharge holes 60*e*.

The friction shaft 100 for a slitter includes third rotary tubes 68 disposed on the outer surface of the first rotary shaft 10 and fitted in the second fitting spaces 60*c*.

In each of the third rotary tubes 68, a fifth fastening hole 68*a* connected to the fourth fastening hole 60*f* by a fastener 5 is formed on the outer surface, a third friction portion 68*b* that generates friction with the first friction portion 31 protrudes at a side of the inner surface, and a fourth fitting space 68*c* is formed at the opposite side of the inner surface.

The friction shaft 100 for a slitter includes third bearings 69 disposed on the outer surface of the first rotary shaft 10 and fitted in the fourth fitting spaces 68*c* to be locked to the third friction portions 68*b*.

The third bearings 69 may be ball bearings.

The first rotary tubes 60 have a locking groove 60*g* formed on the inner surface around the fourth fastening hole 60*f* and the third rotary tubes 68 each have a locking portion 68*d* protruding from the outer surface around the fifth fastening hole 68*a* to be locked to the locking groove 60*g*.

The friction shaft 100 for a slitter includes a third elastic member 70 disposed between the moving passage 11 and the second rotary shaft 40 to return the second rotary shaft 40 that has been moved.

The second elastic members 66 are springs having a shape similar to a ring with high elasticity and the first and third elastic members 64 and 70 are springs having a shape similar to a coil with high elasticity.

A protrusive locking portion 43 inserted in the third elastic member 70 that is a spring is formed on the second rotary shaft 40.

That is, the protrusive locking portion 34 is formed on the second rotary shaft 30 to be immediately locked in the moving passage 11 when the second rotary shaft 40 is moved by pressure of the compressed air and the lugs 67 for clamping are discharged from the second discharge holes 60*e*.

The friction shaft 100 for a slitter includes nozzles 80 each having a side inserted in the tube 20 and the other side fitted in the third supply hole 20*a* and the connection hole 17.

The nozzles 25 have an L-shaped guide space 25*a* so that the supplied compressed air quickly moves in the longitudinal direction of the tubes 20.

The entire length of the bake pads 30 for torque is smaller than the length of the tubes 20.

The friction shaft 100 for a slitter includes sealing members 81 disposed in the first discharge holes 15 at both sides of the brake pads 30 for torque to press and seal both open sides of the tubes 20.

The sealing members 81 each include a first moving plate 81*a* disposed in the first discharge hole 15 in close contact with the tube 20.

The sealing members 81 each include a second moving plate 81*b* disposed in the first discharge hole 15, having locking portions 81*b*' protruding from both sides of the outer surface to be locked to the locking steps 16, and having sixth fastening holes 81*b*" formed at the center portion on the outer surface with predetermined intervals in the longitudinal direction.

The sealing members 81 each include set screws 81*c* fastened in the sixth fastening holes 81*b*".

That is, when the set screws 81*c* are fastened in the sixth fastening holes 81*b*" and press the first moving plate 81*a*, the first moving plate 81*a* is moved by the pressure from the set screws 81*c*, thereby pressing and sealing one open side of the tube 20. Further, as the set screws 81*c* are fastened in the sixth fastening holes 81*b*", the second moving plate 81*b* is moved, whereby the locking portions 81*b*' are locked to the locking steps 16.

The first moving plate 81*a* has protrusive pressing portions 81*a*' formed in L-shapes on a side of the outer surface to press the one open side of the tube 20.

That is, when the set screws 81*c* are fastened in the sixth fastening holes 81*b*", the pressing portions 81*a*' of the first moving plate 81*a* press and seal the one open side of the tube 20 and the opposite side of the outer surface of the first moving plate 81*a* presses and brings the tube 20 in close contact with the nozzle 80.

A protective film 81*d* that protects the tube 20 from damage is attached to the first moving plate 81*a*.

The friction shaft 100 for a slitter includes sealing members such as sealing rings that prevent compressed air to be supplied to the first and second supply holes 12 and 13 from moving to another place or leaking outside.

The friction shaft 100 for a slitter includes spacers that maintain the gaps between the first rotary tubes 60.

The friction shaft 100 for a slitter includes supporting tubes that are disposed on the first rotary shaft to support both sides of first rotary tubes 60.

The friction shaft 100 for a slitter may use a screw type or a cylinder instead of compressed air in order to move the second rotary shaft 40 though the moving passage 11.

The operation and effect of the present invention having the configuration described above are as follows.

As shown in FIGS. 1 to 12B, according to the friction shaft 100 for a slitter of an embodiment of the present invention, the winding tubes 2 are fitted on the first rotary shaft 10 to be able to roll a plurality of unit materials 1*a* on them, respectively, in which the unit materials 1*a* are formed by cutting a raw material 1 such as various kinds of paper, fabric, or film with predetermined intervals.

The friction shaft 100 for a slitter is supplied with compressed air through the air transmitter 4*a* and the air supplier 4 with the winding tubes 2 fitted.

The air supplier 4 supplies appropriate compressed air to decrease the winding tension of the winding tubes 2 when the unit materials 1*a* of the raw material 1 are thin and light, and supplies appropriate compressed air to increase the winding tension of the winding tubes 2 when the unit materials 1*a* of the raw material 1 are thick and heavy.

That is, the friction shaft 100 for a slitter is supplied with compressed air to obtain torque corresponding to the winding tension of the winding tubes 2.

In other words, the friction shaft 100 for a slitter is supplied with compressed air, which can correspond to the thickness and weight of the unit materials 1*a*, from the air supplier 4.

Accordingly, when the compressed air supplied from the air supplier 4 is supplied to the moving passage 11 through the first supply hole 12, the second rotary shaft 40 is moved through the moving passage 11 by the pressure of the compressed air and the pressing members 50 are moved through the moving holes 14.

The second bearings 63 and the second rotary tubes 61 are sequentially pressed by the moving pressing members 50 and the second inclined surfaces 65*a* of the guide members 65 are guided by the first inclined surfaces 61*b*, so the lugs 67 for clamping are discharged from the second discharge holes 60*e* of the first rotary tubes 60 and the discharged lugs 67 for clamping come in close contact with the inner surfaces of the winding tubes 2.

The second rotary shaft 40 can be no longer moved in the moving passage 11 by elasticity of the third elastic member 70 and further cannot be moved because the locking portion 43 is blocked to an end of the moving passage 11, and the pressing members 50 press only the inner races of the second bearings 63.

Since the third elastic member 70 is a spring, it contracts.

The second rotary tubes 61 can be no longer moved in the second fitting spaces 60*c* of the first rotary tubes 60 because the pressing members 50 are locked in the moving holes 14, and further cannot be moved in the second fitting spaces 60*c* of the first rotary tubes 60 by the first elastic members 64 fitted in the fitting holes 60*d* and 61*c*.

Since the first elastic members 64 are springs, they contract.

Further, the locking holes 65*d* are simultaneously locked to the second elastic members 66, so the guide members 65 can no longer move with the lugs 67 for clamping.

Since the second elastic members 66 are springs, the guide members 65 further cannot be moved with the lugs 67 for clamping by elasticity of the second elastic members 66.

The lugs 67 for clamping are not excessive exposed from the second discharge holes 60*e* of the first rotary tubes 60, so the winding tubes 2 are fixed to the lugs 67 for clamping.

On the other hand, when compressed air of the air supplier 4 is separately supplied to the second supply hole 13 through the air transmitter 4*a*, the compressed air is supplied to the third supply holes 30*a* of the tubes 20 after sequentially passing through the second supply hole 13, the moving grooves 41, and the connection holes 17.

The compressed air is guided by the L-shaped guide spaces 80*a* of the nozzles 80, so it quickly moves into the tubes 20 in the longitudinal direction of the tubes 20.

In this process, since the sealing member 81 press and seal both open sides of the tubes 20, the compressed air moving in the tubes 20 cannot flow outside through both open sides of the tubes 20.

In detail, since the set screws 81*c* fastened in the sixth fastening holes 81*b*" press the first moving plates 81*a*, the pressing portions 81*a*' of the first moving plates 81*a* press and seal one open side of each of the tubes 20.

Further, since the opposite side of the outer surfaces of the first moving plates 81*a* where the pressing portions 81*a*' are not formed press and bring the tubes 20 in close contact with the nozzles 80, the one open side of each of the tubes 20 is further sealed.

Since the protective films 81*d* are attached to the first moving plates 81*a*, the tubes 20 are not damaged by the protective films 81*d* even though the first moving plates 81*a* keep pressing the tubes 20.

The second moving plates 81*b* are moved by fastening the set screws 81*c* in the sixth fastening holes 81*b*" and the locking portions 81*b*' are locked and fixed to the locking steps 16 of the first rotary shaft 10, so one side of each of the tubes 20 is kept sealed.

That is, both open sides of the tubes 20 are sealed by the sealing members 81.

The first friction portions 31 of the brake pads 30 for torque are discharged from the first discharge holes 15 by expansion of the tubes 20 and come in close contact with the second friction portions 60*a* of the first rotary tubes 60.

The first friction portions 31 of the brake pads 30 for torque also come in close contact with the third friction portions 68*b* of the third rotary tubes 68.

That is, the first and third rotary tubes 60 and 18 are fixed to the brake pads 30 for torque.

The locking portions 32 are locked to the locking steps 16 of the first rotary shaft 10, so brake pads 30 for torque can move no longer.

Then, the friction shaft 100 for a slitter with the winding tubes 2 fixed is rotated by operating the driving motor 3 of the slitter 6.

The first rotary shaft 10 is rotated by the driving motor 3 and the second rotary shaft 40 is rotated with the pressing members 50 locked in moving holes 14 of the first rotary shaft 10.

The first and third rotary tubes 60 and 68 are rotated with friction generated between the first friction portions 31 of the brake pads 30 for torque rotated with the first rotary shaft 10 and the second and third friction portions 60*a* and 68*b* of the first and third rotary tubes 60 and 60.

Since the fourth fastening holes 60*f* and the fifth fastening holes 68*a* are fastened to each other by the fasteners 5, the first and third rotary tubes 60 and 68 are rotated together.

The lugs 67 for clamping are locked in the second discharge holes 60*e* of the rotating first rotary tubes 60, the guide members 65 coupled to the rotating lugs 67 for clamping are locked in the locking holes 61*a* of the second rotary tubes 61, and the first elastic members 64 fitted in the fitting holes 61*c* of the second rotary tubes 61 are locked in the fitting holes 60*d* of the rotating first rotary tubes 60, whereby the second rotary tubes 61 are also rotated.

Accordingly, the winding tubes 2 are rotated together by friction on the inner surfaces of the winding tubes 2 being in close contact with the lugs 67 for clamping.

That is, the winding tubes 2 wind the unit materials 1*a* with predetermined winding tension.

The winding tube 2 that winds a unit material 1*a* corresponding to a width-directional thicker portion of the raw material 1 generates larger winding tension than winding tubes 2 around it.

That is, the winding tension of the winding tube 2 is larger than torque of the first and second rotary shafts 10 and 40 of the friction shaft 100 for a slitter.

The winding tube 2 is rotated with the first, second, and third rotary tubes 60, 61, and 60 by the first, second, and third bearings 62, 63, and 69, thereby rotating slower than the first and second rotary shafts 10 and 40.

That is, slip is generated between the winding tube 2, the first, second, and third rotary tubes 60, 61, and 68, and the first and second rotary shaft 10 and 40 regardless of the brake pads 30 for torque, so the winding tube 2 winds the unit material 1 while rotating slower than winding tubes 2 around it.

In other words, the winding tension of the winding tube 2 becomes the same as the winding tension of the winding tubes 2 around it.

Accordingly, when the unit materials 1*a* are rolled around the winding tubes 2 fixed to the friction shaft 100 for a slitter, supply of compressed air to the friction shaft 100 for a slitter is stopped and the operation of the driving motor 3 is stopped.

Accordingly, the second rotary shaft 30 is returned through the moving passage 11 by the elasticity of the third elastic member 70.

Further, the first inclined surfaces 61*b* of the second rotary tubes 61 are guided on the second inclined surfaces 65*a* of the guide members 65 by elasticity of the first and second elastic members 64 and 66 and the lugs 67 for clamping are inserted back into the second discharge holes 60*e* of the first rotary tubes 60.

The tubes 20 are contracted due to reduction of the compressed air and the first friction portions 31 of the brake pads 30 for torque are inserted back into the first discharge holes 15.

Accordingly, the close contact between the inner surfaces of the winding tubes 2 and the lugs 67 for clamping and the close contact between the second and third friction portions 60*a* and 68*b* of the first and third rotary tubes 60 and 68 and the first friction portions 31 of the brake pads 30 for torque are removed.

Then, the winding tubes 2 with the unit materials 1*a* wound thereon are pulled out from the outer surface of the friction shaft 100 for a slitter of the present invention, thereby finishing winding.

Although the present invention was described above with reference to specific embodiments, the present invention is not limited to the embodiments and may be changed and modified in various ways by those skilled in the art without departing from the scope of the present invention.

What is claimed is:

1. A friction shaft for a slitter that has winding tubes disposed on an outer surface thereof to roll unit materials formed by cutting a raw material such as various kinds of paper, fabric, or film with predetermined intervals, the friction shaft comprising a first rotary shaft rotated by a driving motor and supplied with compressed air from an air supplier, wherein, in the first rotary shaft, a moving passage elongated in a longitudinal direction of the first rotary shaft is formed in the first rotary shaft, first and second supply holes for receiving the compressed air are formed at a side of an outer surface to be connected with the moving passage, moving holes connected with the moving passage are formed with predetermined intervals at an opposite side of the outer surface in the longitudinal direction of the first rotary shaft and are arranged around the first rotary shaft with predetermined intervals, first discharge holes are formed at the opposite side of the outer surface to be longer than the moving holes in the longitudinal direction of the first rotary shaft and are arranged with predetermined intervals around the first rotary shaft between the moving holes, locking steps protrude from open ends of the first discharge holes, and connection holes connecting the moving passage and the first discharge holes are formed therein, the friction shaft includes tubes disposed in the first discharge holes and having third supply holes connected with the connection holes, the friction shaft includes brake pads for torque that are disposed in the first discharge holes to be adjacent to each other, have a first friction portion protruding from an outer surface thereof, and have a locking portion protruding from the outer surface around the first friction portion to be locked to the locking step, the friction shaft includes a second rotary shaft disposed to be movable through the moving passage, wherein, in the second rotary shaft, moving grooves for sending compressed air supplied from the second supply holes to the connection holes are formed in a circular shape and elongated on a side of an outer surface in a longitudinal direction of the second rotary shaft, and first fastening holes facing the moving holes are formed with predetermined intervals on an opposite side of the outer surface in the longitudinal direction of the second rotary shaft and are arranged with predetermined intervals around the second rotary shaft, the friction shaft includes pressing members fastened in the first fastening holes and exposed from the moving holes, the friction shaft includes first rotary tubes disposed on the outer surface of the first rotary shaft to be adjacent to each other in the longitudinal direction of the first rotary shaft with the winding tubes on outer surfaces thereof, wherein, in each of the first rotary tubes, a second friction portion that generates friction with the first friction portion protrudes from an inner surface, first and second fitting spaces are formed at both sides of the second friction portion, fitting holes are formed on a side, which faces the second fitting space, of the second friction portion with predetermined intervals around the first rotary tube, and second discharge holes connected with the second fitting space are formed on an outer surface with predetermined intervals around the first rotary tube, the friction shaft includes second rotary tubes disposed on the outer surface of the first rotary shaft and movably fitted in the second fitting spaces, wherein, in each of the second rotary tubes, locking holes facing the second discharge holes are formed on an outer surface with predetermined intervals around the second rotary tube, first inclined surfaces are formed in the locking holes, fitting holes facing the fitting holes are formed on the outer surface with predetermined intervals around the second rotary tube, locking steps protrude at a side of an inner surface close to the fitting holes, and a third fitting space is formed at an opposite side of the inner surface, the friction shaft includes first and second bearings that are fitted in the first and third fitting spaces, respectively to be locked to the second friction portions and locking steps and are disposed on the outer surface of the first rotary shaft, the friction shaft includes first elastic members fitted in the fitting holes, the friction shaft includes guide members that are disposed in the second discharge holes, have a second inclined surface formed at a side of an outer surface to be guided by the first inclined surface, have a locking hole formed at an opposite side of the outer surface, and have a second fastening hole formed on the outer surface around the locking hole, the friction shaft includes second elastic members fitted in the locking holes of the pressing members, the friction shaft includes lugs for clamping that are disposed in the second discharge holes and have a third fastening hole connected to the second fastening hole by a fastener, when the compressed air is supplied to the moving passage through the first supply hole, the second rotary shaft is moved through the moving passage by pressure of the compressed air and the pressing members are moved through the moving holes, the second bearings and the second rotary tubes are sequentially pressed by the moving pressing members, and the second inclined surfaces are guided by the first inclined surfaces, so the lugs for clamping are discharged from the second discharge holes and the discharged lugs for clamping come in close contact with inner surfaces of the winding tubes, and when the compressed air is supplied to the third supply holes sequentially through the second supply hole, the moving grooves, and the connection holes, the tubes are expanded and the first friction portions of the brake pads for torque are discharged from the first discharge hole and come in close contact with the second friction portions of the first rotary tubes.

2. The friction shaft of claim 1, wherein fourth fastening holes connected with the second fitting spaces are formed on an outer surface around the second discharge holes, the friction shaft includes third rotary tubes disposed on the outer surface of the first rotary shaft and fitted in the second fitting spaces, in each of the third rotary tubes, a fifth fastening hole connected to the fourth fastening hole by a fastener is formed on an outer surface, a third friction portion that generates friction with the first friction portion protrudes at a side of an inner surface, and a fourth fitting space is formed at an opposite side of the inner surface, and the friction shaft includes third bearings disposed on the outer surface of the first rotary shaft and fitted in the fourth fitting spaces to be locked to the third friction portions.

3. The friction shaft of claim 2, wherein the first rotary tubes each have a locking groove formed on an inner surface around the fourth fastening hole, and the third rotary tubes each have a locking portion protruding from an outer surface around the fifth fastening hole to be locked to the locking groove.

4. The friction shaft of claim 1, comprising the friction shaft includes a third elastic member disposed between the moving passage and the second rotary shaft to return the second rotary shaft that has been moved.

5. The friction shaft of claim 1, wherein the second elastic members are springs having a shape similar to a ring.

6. The friction shaft of claim 1, the first and third elastic members are springs having a shape similar to a coil.

7. The friction shaft of claim 6, wherein a protrusive locking portion inserted in the third elastic member that is a spring is formed on the second rotary shaft, and the locking portion is locked in the moving passage when the second rotary shaft is moved by pressure of the compressed air and the lugs for clamping are discharged from the second discharge holes.

8. The friction shaft of claim 1, further comprising nozzles each having a side inserted in the tube and the other side fitted in the third supply hole and the connection hole, wherein the nozzles each have an L-shaped guide space so that the supplied compressed air quickly moves in the longitudinal direction of the tubes.

9. The friction shaft of claim 8, wherein entire length of the bake pads for torque is smaller than length of the tubes, and the friction shaft includes sealing members disposed in the first discharge holes at both sides of the brake pads for torque to press and seal both open sides of the tubes.

10. The friction shaft of claim 9, wherein the sealing members each include:

a first moving plate disposed in the first discharge hole in close contact with the tube;

a second moving plate disposed in the first discharge hole, having locking portions protruding from both sides of an outer surface to be locked to the locking steps, and having sixth fastening holes formed at a center portion on an outer surface with predetermined intervals in a longitudinal direction; and a set screw fastened in the sixth fastening hole, and when the set screws are fastened in the sixth fastening holes and press the first moving plate, the first moving plate is moved by pressure from the set screws and presses and seals one open side of the tube, the second moving plate is moved due to fastening of the set screws in the sixth fastening holes and the locking portions are locked to the locking steps.

11. The friction shaft of claim 10, wherein the first moving plate has protrusive pressing portions formed on a side of an outer surface to press the one open side of the tube, and when the set screws are fastened in the sixth fastening holes, the pressing portions of the first moving plate press and seal the one open side of the tube and an opposite side of the outer surface of the first moving plate presses and brings the tube in close contact with the nozzle.

12. The friction shaft of claim 11, wherein a protective film that protects the tube from damage is attached to the first moving plate.

13. The friction shaft of claim 4, the first and third elastic members are springs having a shape similar to a coil.

14. The friction shaft of claim 13, wherein a protrusive locking portion inserted in the third elastic member that is a spring is formed on the second rotary shaft, and the locking portion is locked in the moving passage when the second rotary shaft is moved by pressure of the compressed air and the lugs for clamping are discharged from the second discharge holes.

* * * * *